US009938797B2

(12) United States Patent
MacDonald

(10) Patent No.: US 9,938,797 B2
(45) Date of Patent: Apr. 10, 2018

(54) SHAPE-MEMORY ALLOY ACTUATED FASTENER

(71) Applicant: HALLIBURTON ENERGY SERVICES, INC., Houston, TX (US)

(72) Inventor: Lorn Scott MacDonald, Inverness (GB)

(73) Assignee: Halliburton Energy Services, Inc., Houston, TX (US)

( * ) Notice: Subject to any disclaimer, the term of this patent is extended or adjusted under 35 U.S.C. 154(b) by 280 days.

(21) Appl. No.: 14/653,931

(22) PCT Filed: Jun. 30, 2014

(86) PCT No.: PCT/US2014/044832
§ 371 (c)(1),
(2) Date: Jun. 19, 2015

(87) PCT Pub. No.: WO2016/003405
PCT Pub. Date: Jan. 7, 2016

(65) Prior Publication Data
US 2016/0258248 A1 Sep. 8, 2016

(51) Int. Cl.

| | |
|---|---|
| ***E21B 34/06*** | (2006.01) |
| ***E21B 17/02*** | (2006.01) |
| ***E21B 17/04*** | (2006.01) |
| ***E21B 17/046*** | (2006.01) |

(52) U.S. Cl.
CPC ..... *E21B 34/06* (2013.01); *E21B 17/02* (2013.01); *E21B 17/04* (2013.01); *E21B 17/046* (2013.01)

(58) Field of Classification Search
CPC ..... E21B 17/02; E21B 17/04; E21B 17/043; E21B 34/14
See application file for complete search history.

(56) References Cited

U.S. PATENT DOCUMENTS

| | | | | |
|---|---|---|---|---|
| 2005/0172462 | A1 | 8/2005 | Rudduck et al. | |
| 2006/0048936 | A1* | 3/2006 | Fripp | E21B 43/12 166/244.1 |
| 2007/0071575 | A1* | 3/2007 | Rudduck | B62D 27/00 411/386 |
| 2008/0264647 | A1* | 10/2008 | Li | E21B 17/042 166/373 |
| 2012/0055667 | A1* | 3/2012 | Ingram | E21B 33/1208 166/65.1 |

(Continued)

FOREIGN PATENT DOCUMENTS

| | | |
|---|---|---|
| WO | 2004018833 | 3/2004 |

OTHER PUBLICATIONS

Duerig et al., A Shape-Memory Alloy for High-Temperature Applications, Journal of Metals, pp. 14-20, Dec. 1982, 8 pages.

(Continued)

*Primary Examiner* — Jennifer H Gay
(74) *Attorney, Agent, or Firm* — Kilpatrick Townsend & Stockton LLP

(57) ABSTRACT

An assembly includes a fastener deployable in a wellbore and actuated by a shape-memory alloy. The shape-memory alloy releaseably interlocks multiple components deployed in the wellbore. The physical shape of the shape-memory alloy can be selectively changed between a first shape and a second shape.

20 Claims, 9 Drawing Sheets

(56) References Cited

U.S. PATENT DOCUMENTS

| | | | | |
|---|---|---|---|---|
| 2012/0261137 | A1* | 10/2012 | Martinez | E21B 34/06 166/373 |
| 2013/0087334 | A1 | 4/2013 | Buytaert et al. | |
| 2013/0255961 | A1* | 10/2013 | Frisby | E21B 33/12 166/373 |
| 2016/0258248 | A1* | 9/2016 | MacDonald | E21B 17/02 |

OTHER PUBLICATIONS

Halliburton Energy Services, Inc , FS Fluid Loss Isolation Barrier Valve, 2013, 2 pages.

Herfjord et al., Feasibility Study of Shape Memory Alloys in Oil Well Applications, IKU Petroleum Research, Report No. 32.0896. 00/01/97, Jun. 23, 1997, 128 pages.

International Patent Application No. PCT/US2014/044832, International Search Report and Written Opinion, dated Mar. 27, 2015, 14 pages.

Redfern , New shape-shifting metals discovered, BBC News, Science & Environment, Oct. 4, 2013, 2 pages.

* cited by examiner

SHAPE-MEMORY ALLOY ACTUATED FASTENER

CROSS-REFERENCE TO RELATED APPLICATIONS

This is a U.S. national phase under 35 U.S.C. § 371 of International Patent Application No. PCT/US2014/044832, titled "Shape-Memory Alloy Actuated Fastener" and filed Jun. 30, 2014, the entirety of which is hereby incorporated by reference herein.

TECHNICAL FIELD

The present disclosure relates generally to devices for fastening components to each other. More specifically, but not by way of limitation, this disclosure relates to a fastener actuated by a shape-memory alloy.

BACKGROUND

One or more fasteners (e.g., latches, bolts, lugs, and clamps) can mechanically interlock two or more components of a system together. Fasteners can be releasable. That is, some fasteners can be selectively disengaged to free the interlocked components from one another. Typically, fasteners can be actuated (i.e., selectively engaged or disengaged) by hand, motor, or by applying hydraulic pressure to the fastener. Actuating a fastener by hand, however, can be impractical or impossible when the fastener is in a remote location, such as in a wellbore. Actuating a fastener via a motor can be inefficient and impractical, as motors can be large in size, expensive, prone to mechanical failures, and require significant power for operation. Further, actuating a fastener via hydraulic pressure can be too time consuming and uncontrollable for some applications. Accordingly, it can be challenging to quickly, remotely, and selectively actuate a fastener.

DETAILED DESCRIPTION

Figure 1:
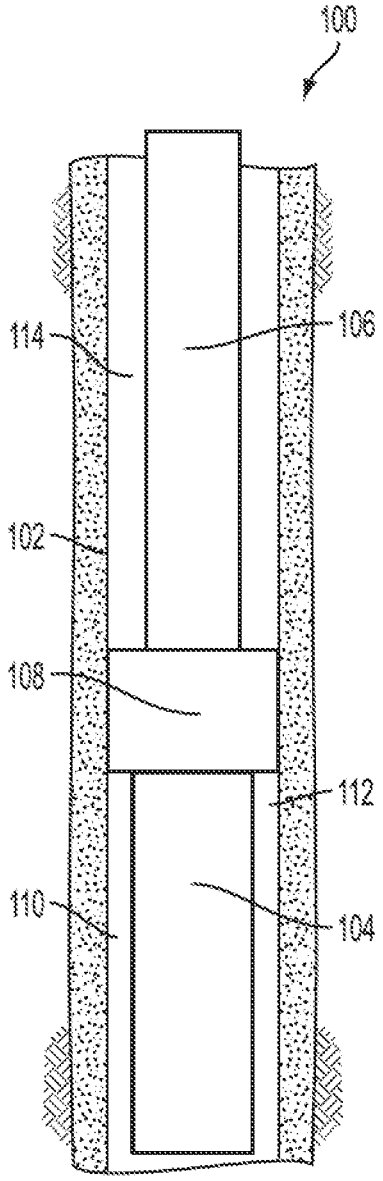
FIG. 1 is a cross-sectional view of one embodiment of a well system that can include a shape-memory alloy actuated fastener according to one embodiment of the present disclosure.

Certain aspects and features of the present disclosure are directed to a shape-memory alloy actuated fastener. The shape-memory alloy actuated fastener can be, or can be included in, a latch (e.g., a collet latch or C-latch), bolt, lug, clamp, spring, threaded connector, dog, or wire. The shape-memory alloy actuated fastener can include a shape-memory alloy. A shape-memory alloy can include an alloy of metals with atoms that can be arranged in two different crystal structures. Each crystal structure can define a physical shape for the shape-memory alloy. At colder temperatures, the atoms can be arranged in one crystal structure, which can define one physical shape (i.e., the low-temperature shape) for the shape-memory alloy. When heated above a transition temperature, the atoms can rearrange to the other crystal structure, which can define another physical shape (i.e., the high-temperature shape) for the shape-memory alloy. In some embodiments, the shape-memory alloy can substantially revert back to its low-temperature shape when cooled back below the transition temperature. By heating or cooling the shape-memory alloy, the shape-memory alloy can change between two physical shapes. Because the fastener can include the shape-memory alloy, the fastener can change between two physical shapes upon the heating or cooling of the fastener.

The fastener can be configured for selectively interlocking or releasing (i.e., engaging or disengaging) multiple components. For example, in some embodiments, the fastener's low-temperature shape can be configured to interlock multiple components. The fastener's high-temperature shape can be configured to release the multiple components from one another. The fastener can interlock multiple components when in its low-temperature shape. When heated above a transition temperature, the fastener can change into its high-temperature shape and release the multiple components from one another. In some embodiments, when cooled back below the transition temperature, the fastener can change substantially back into its low-temperature shape, which can again interlock the multiple components. In this way, the fastener can be actuated by selectively heating or cooling the fastener. Further, in some embodiments, the fastener's high-temperature shape and low-temperature shape can be reversed. That is, in some embodiments, the fastener's high-temperature shape can be configured to interlock multiple components, while the fastener's low-temperature shape can be configured to release the multiple components from one another.

In one example, the shape-memory alloy actuated fastener can be a part of a valve deployed in a wellbore. A wellbore is a hole drilled in a subterranean formation as part of a well system (e.g., for extracting fluid or gas from the subterranean formation). The valve can control the flow of fluid or gas through the wellbore. The valve can include a shape-memory alloy actuated fastener which, when in its low-temperature shape, can interlock multiple valve components to effectively close the valve. When closed, the valve can prohibit fluid or gas from flowing through the wellbore. A temperature-control device, for example a heating blanket, can be positioned within the valve or otherwise thermally coupled to the shape-memory alloy actuated fastener. A well operator can operate the temperature-control device, for example, by transmitting power to the temperature-control device. The temperature-control device can heat the shape-memory alloy actuated fastener above a transition temperature, which can cause the shape-memory alloy actuated fastener to change its physical shape to its high-temperature shape. Upon changing to its high-temperature shape, the shape-memory alloy actuated fastener can release the valve components to effectively open the valve. When open, the valve can permit fluid or gas to flow through the well system. In some embodiments, the temperature-control device can cool the shape-memory alloy actuated fastener back below the transition temperature, which can cause the shape-memory alloy actuated fastener to substantially change its physical shape back into its low-temperature shape. In this way, the well operator can quickly, remotely, and selectively control the valve via the shape-memory alloy actuated fastener.

Although the shape-memory alloy actuated fastener was described in the above example as part of a well-system component, a shape-memory alloy actuated fastener can be used in a variety of other contexts to perform numerous functions. For example, in some embodiments, a shape-memory alloy actuated fastener can be used with, or be a part of, an automobile, aircraft, boat, computer, appliance, furniture piece, machine, toy, sports equipment, electrical system, or other device. Further, embodiments can include multiple shape-memory alloy actuated fasteners configured in any number of ways.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of one embodiment of a well system 100 that can include a shape-memory alloy actuated fastener according to one embodiment of the present disclosure. The well system 100 includes a wellbore 102. In some embodiments, the wellbore 102 can be cased and cemented, as shown in FIG. 1. In other embodiments, the wellbore 102 can be uncased or the casing may not be cemented.

The wellbore 102 can include a tubular string 104, for example, a lower completion assembly. The tubular string 104 can be positioned in the lower portion 112 of the wellbore 102. Annulus 110 can be formed between the tubular string 104 and the wellbore 102.

The wellbore 102 can also include a well-system component 108, for example, an isolation barrier valve, packer, plug, sliding sleeve, running tool, setting tool latching tool, shear joint, travel joint, or another type of valve (e.g., a safety valve, flapper valve, or ball valve). In some embodiments, the well-system component 108 can include a shape-memory alloy actuated fastener (discussed further with respect to FIG. 2). The well-system component 108 can also include a temperature-control device (e.g., a heating device or cooling device) for actuating the shape-memory alloy actuated fastener.

The wellbore 102 can further include another tubular string 106, for example, an upper completion assembly. The tubular string 106 can be positioned in the upper portion 114 of the wellbore 102. Although depicted in this example as connected to the well-system component 108, in some embodiments, the tubular string 106 can be disconnected from the well-system component 108. Further, some embodiments may not include the tubular string 104 or the tubular string 106, and may include other well-system components.

Figure 2:
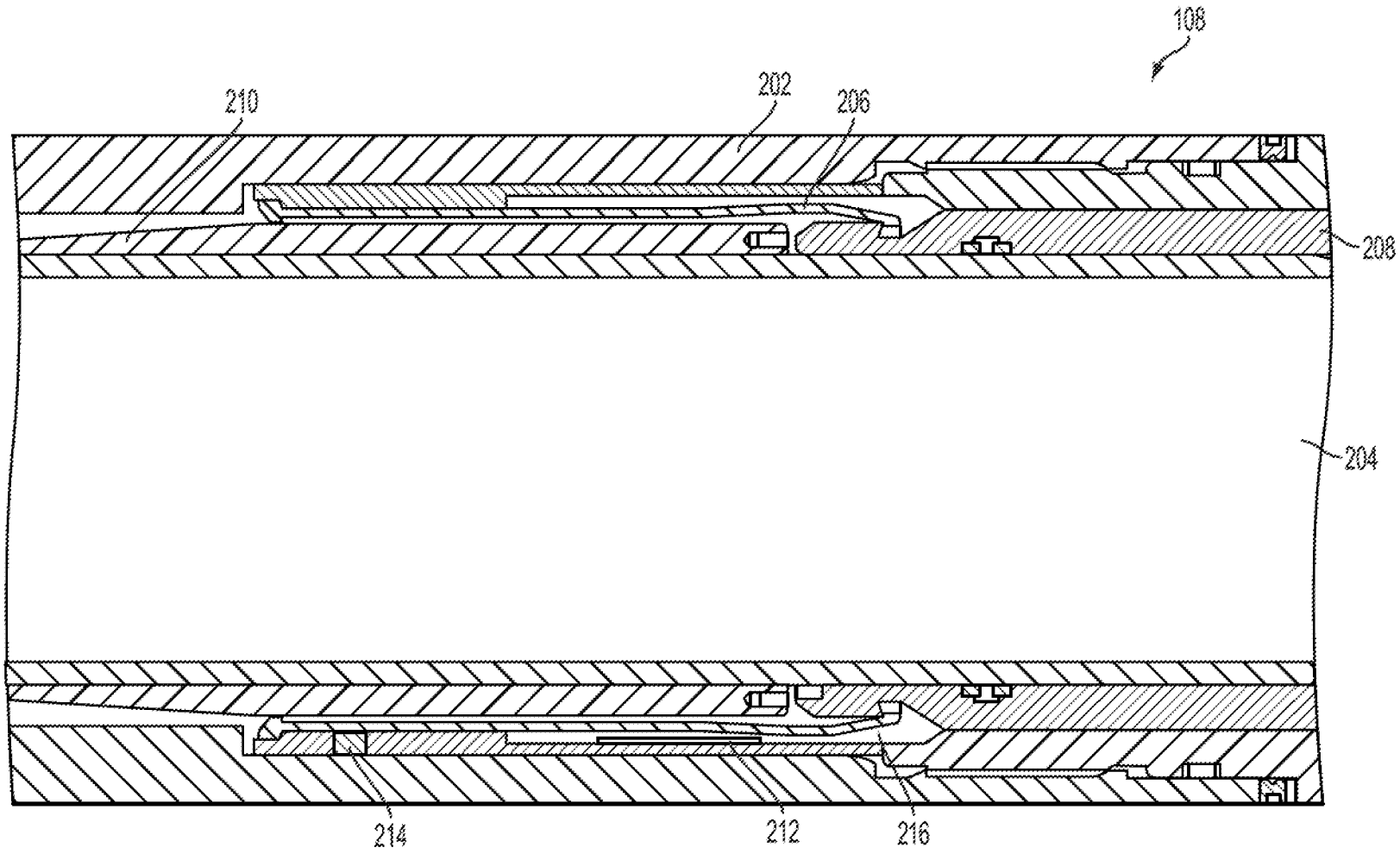
FIG. 2 is a cross-sectional side view of a well system component shown in FIG. 1 according to one embodiment of the present disclosure.

FIG. 2 is a cross-sectional side view of the well-system component 108 shown in FIG. 1 according to one embodiment of the present disclosure. In some embodiments, the well-system component 108 is, or can include, a valve, for example, an isolation barrier valve. An isolation barrier valve can isolate the lower portion of the wellbore from an upper portion of the wellbore, which can prevent or minimize fluid or gas communication between the lower portion of the wellbore and the upper portion of the wellbore.

The well-system component 108 can include a housing 202. A tube 204 can be disposed within the housing 202 for communicating fluid or gas through the well-system component 108. Further, the well-system component 108 can include a shape-memory alloy actuated fastener 206, for example, the shape-memory alloy actuated fastener 206 depicted in FIG. 3.

Figure 3:
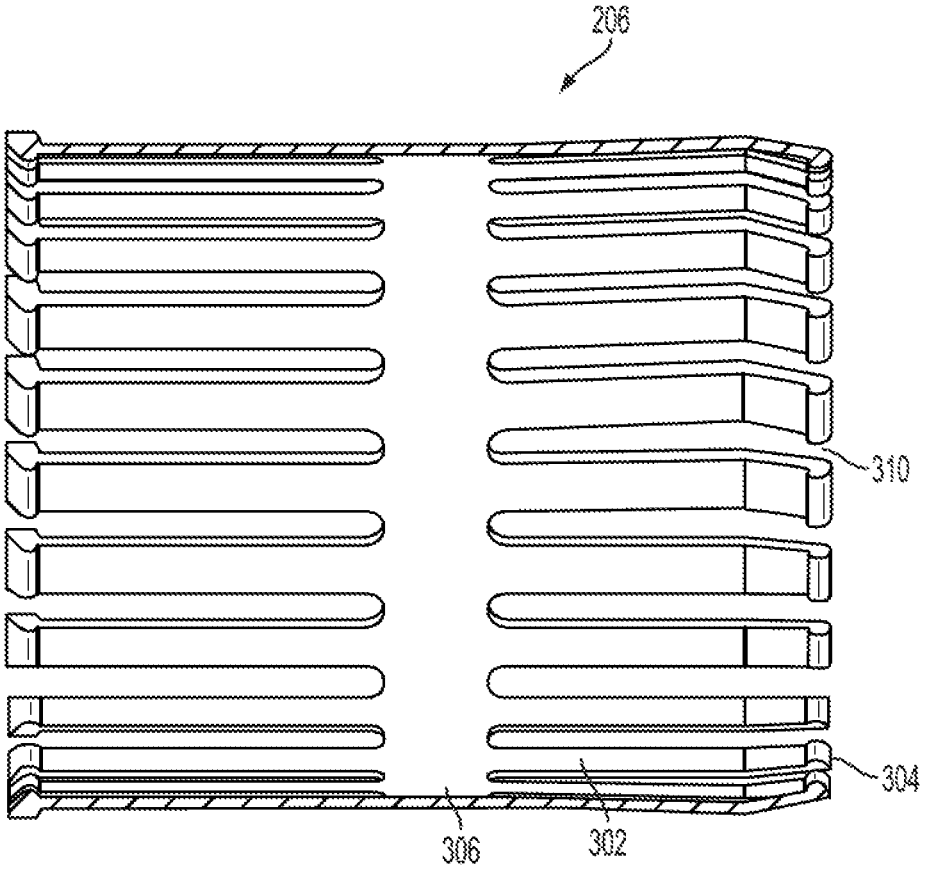
FIG. 3 is a cross-sectional side view of a shape-memory alloy actuated fastener in a first position according to one embodiment of the present disclosure.

FIG. 3 is a cross-sectional side view of a shape-memory alloy actuated fastener 206 in a first position according to one embodiment of the present disclosure. In this example, the shape-memory alloy actuated fastener 206 is a collet latch.

The shape-memory alloy actuated fastener 206 can include a body 306. In some embodiments, the body 306 can include a ring shape. In other embodiments, the body 306 can include another shape, for example a square, triangular, rectangular, or trapezoidal shape. In some embodiments, the body 306 can include a cavity, for example, for allowing one or more components to fit through the body 306.

An annular array of fingers 302 can extend from an end of the body 306. In this example, the annular array of fingers 302 extends from both ends of the body 306. The fingers 302 can include enlarged ends 304. In some embodiments, the enlarged ends 304 can be positioned on the ends of the fingers 302. The enlarged ends 304 can releaseably interlock with a component, for example, a component of a valve in a wellbore. In some embodiments, the enlarged ends 304 can include a back-angle configuration for interlocking with a component. That is, the enlarged ends 304 can angle backwards towards the body 306 of the shape-memory alloy actuated fastener 206. In other embodiments, the enlarged ends 304 can include other configurations for interlocking with a component, for example, a 90-degree configuration. A 90-degree configuration can include enlarged ends 304 that extend perpendicularly (i.e., 90 degrees) from the fingers 302.

The shape-memory alloy actuated fastener 206 can include a shape-memory alloy, which can include, for example, nickel (Ni), titanium (Ti), copper (Cu), aluminum (Al), zinc (Zn), iron (Fe), manganese (Mn), silicon (Si), hafnium (Hf), palladium (Pd), or gold (Au). In some embodiments, the shape-memory alloy actuated fastener 206 can include, for example, Ni—Ti, Ni—Al, Cu—Al—Ni, Cu—Zn—Al, Fe—Mn—Si, Fe—Ni—Co—Ti, Ni—Ti—Hf, or Ni—Ti—Pd.

In some embodiments, the entire shape-memory alloy actuated fastener 206 can include a shape-memory alloy. In other embodiments, one or more parts of the shape-memory alloy actuated fastener 206, for example the fingers 302 and/or the enlarged ends 304, can include the shape-memory alloy.

In some embodiments, one or more parts of the shape-memory alloy actuated fastener 206 that directly releasably couple with a component can include the shape-memory alloy. For example, in some embodiments, the enlarged ends 304 of the shape-memory alloy actuated fastener 206 can include a shape-memory alloy, and can directly interlock with or release a component. In other embodiments, the shape-memory alloy can cause (e.g., directly or indirectly) a part of the shape-memory alloy actuated fastener 206, which may not include the shape-memory alloy, to releaseably couple with a component. For example, the body 306 of the shape-memory alloy actuated fastener 206 can include a shape-memory alloy. The shape-memory alloy can be configured to cause the annular array of fingers 302 and the enlarged ends 304, which may not include a shape-memory alloy, to releaseably couple with a component. In some embodiments, the shape-memory alloy can push, pull, move, or otherwise interact with a part of the shape-memory alloy actuated fastener 206, which can cause the shape-memory alloy actuated fastener 206 to releaseably interlock with a component.

Further, in some embodiments, the shape-memory alloy actuated fastener 206 can include multiple shape-memory alloys. For example, in some embodiments, the shape-memory alloy actuated fastener 206 can include multiple shape-memory alloys with different transition temperatures. Different components of the shape-memory alloy actuated fastener 206 can be actuated at different times by applying different amounts of heat to the shape-memory alloy actuated fastener 206.

Returning to FIG. 2, the shape-memory alloy actuated fastener 206 can interlock with a receiving component 208, for example, a latch crossover. When the shape-memory alloy actuated fastener 206 is interlocked with the receiving component 208, the receiving component 208 can keep a closure component (e.g., a ball) in the well-system component 108 in a closed position. This can close the well-system component 108, which can, for example, prevent or minimize fluid or gas communication through the well-system component 108.

Further, the well-system component 108 can also include a power supply 214, for example, one or more C-sized batteries. Although the power supply 214 is depicted in this example as disposed within the well-system component 108, in other embodiments, the power supply 214 can be positioned elsewhere, for example, the power supply 214 can be coupled to other well-system components or positioned aboveground.

An operator (e.g., a well operator) can control the power supply 214. In some embodiments, an operator can control the power supply 214 via a computing device (not shown), which can be in communication with the power supply 214. The computing device can include a processor interfaced with other hardware via a bus. A memory, which can include any suitable tangible (and non-transitory) computer-readable medium such as RAM, ROM, EEPROM, or the like, can include program components that configure operation of the computing device. The computing device can also include input/output interface components and additional storage.

Further, each of the computing device and the power supply 214 can include a communication device (not shown) for communicating with one another. In some embodiments, the communication device can include one or more of any components that facilitate a network connection. For example, in some embodiments, the communication device can be wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In other embodiments, the communication device can be wired and can include interfaces such as Ethernet, USB, or IEEE 1394.

The power supply 214 can be in communication with a temperature-control device 212, for example a heating blanket (e.g., a ceramic heating blanket). The temperature-control device 212 can be coupled to or in thermal communication with the shape-memory alloy actuated fastener 206. In some embodiments, an area 216 surrounding the temperature-control device 212 can be insulated, for example, to prevent heat loss. Upon receiving the power from the power supply 214, the temperature-control device 212 can heat or cool the shape-memory alloy actuated fastener 206. This can cause the shape-memory alloy actuated fastener 206 to change its physical shape, for example, as shown in FIG. 4.

Figure 4:
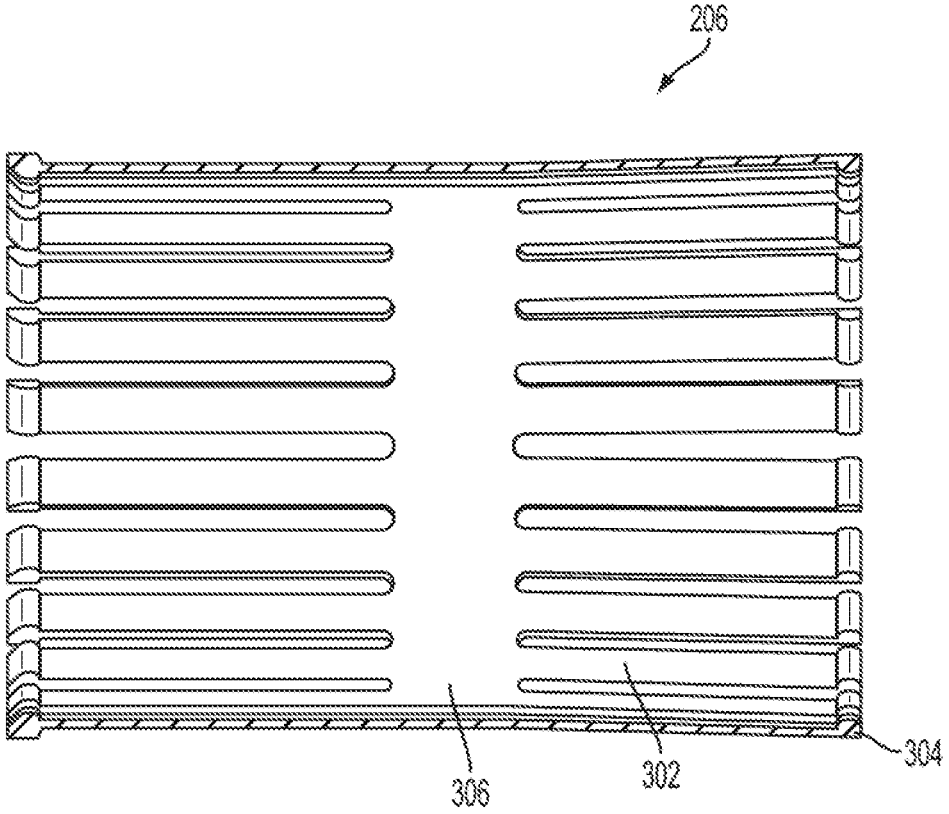
FIG. 4 is a cross-sectional side view of the shape-memory alloy actuated fastener shown in FIG. 3 in a second position according to one embodiment of the present disclosure.

FIG. 4 is a cross-sectional side view of the shape-memory alloy actuated fastener shown in FIG. 3 in a second position according to one embodiment of the present disclosure. In some embodiments, one or more fingers in the annular array of fingers 302 in the shape-memory alloy actuated fastener 206 can bend radially outward. This can increase the diameter of the annular array of fingers 302. In other embodiments, one or more of the fingers in the annular array of fingers 302 can bend radially inward, which can decrease the diameter of the annular array of fingers 302. Further, in some embodiments, the length or width of one or more of the fingers in the annular array of fingers 302 can increase or decrease or size.

Further, in some embodiments, the body 306 or the enlarged ends 304 can change physical shape, for example, to enhance the decoupling or releasing of a component. For example, in some embodiments, the enlarged ends 304 can change shape from a back-angled configuration to a 90-degree configuration. Any number of shape-memory alloy actuated fastener 206 parts can change physical shape at any number of transition temperatures, and any configuration of physical shapes may be possible.

Figure 5:
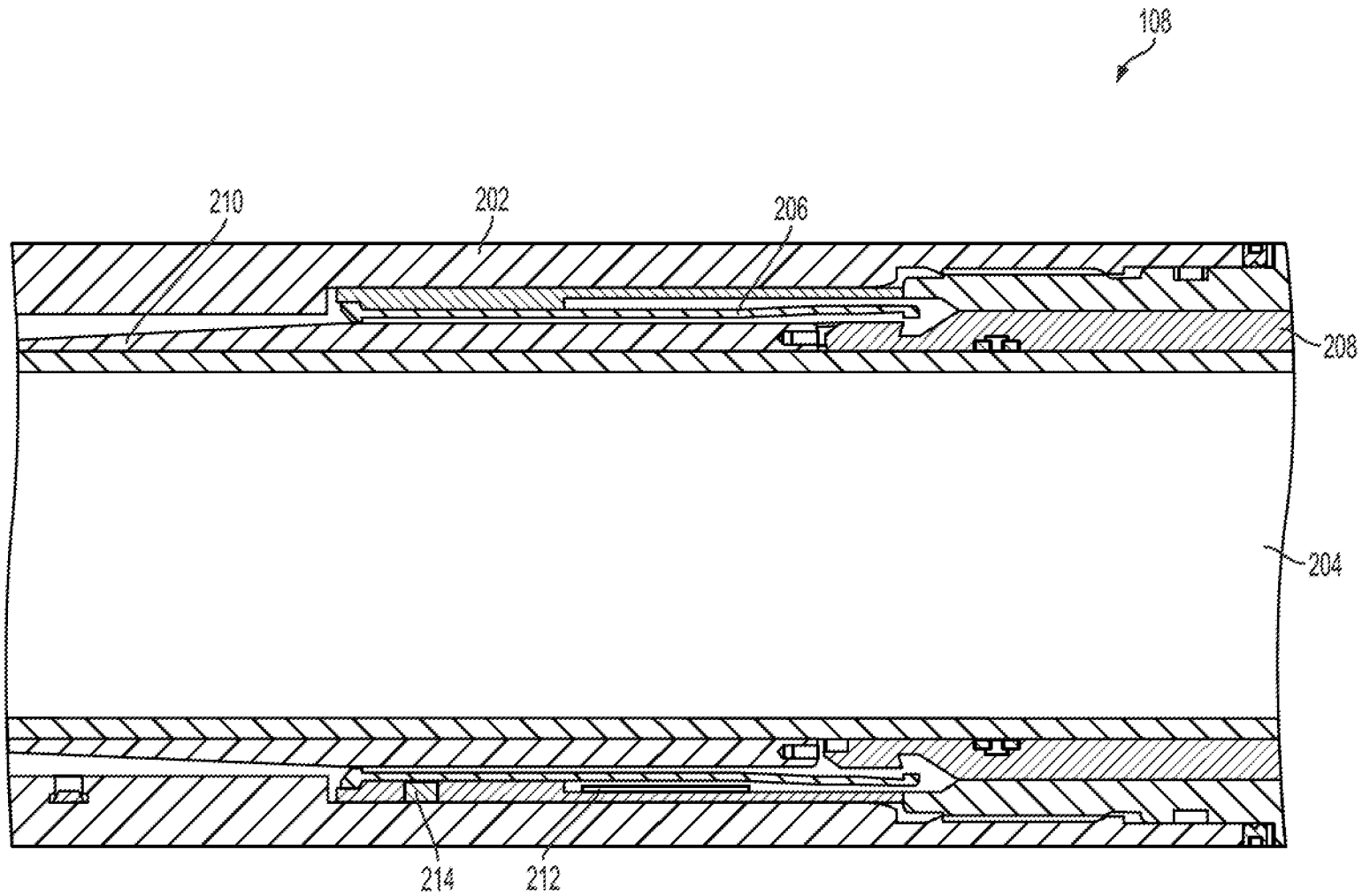
FIG. 5 is a cross-sectional side view of the well system component shown in FIG. 2 in which the shape-memory alloy actuated fastener has released a receiving component according to one embodiment of the present disclosure.

Returning again to FIG. 2, as noted above, upon receiving the power from the power supply 214, the temperature-control device 212 can cause the shape-memory alloy actuated fastener 206 to change shape (e.g., change to its high-temperature shape). As the shape-memory alloy actuated fastener 206 changes shape, the shape-memory alloy actuated fastener 206 can release from the receiving component 208, for example, as shown in FIG. 5. In some embodiments, the shape-memory alloy actuated fastener 206 and/or the receiving component 208 can be coated with a low friction coating, for example, to enhance the decoupling or releasing of the shape-memory alloy actuated fastener 206 from the receiving component 208.

Figure 6:
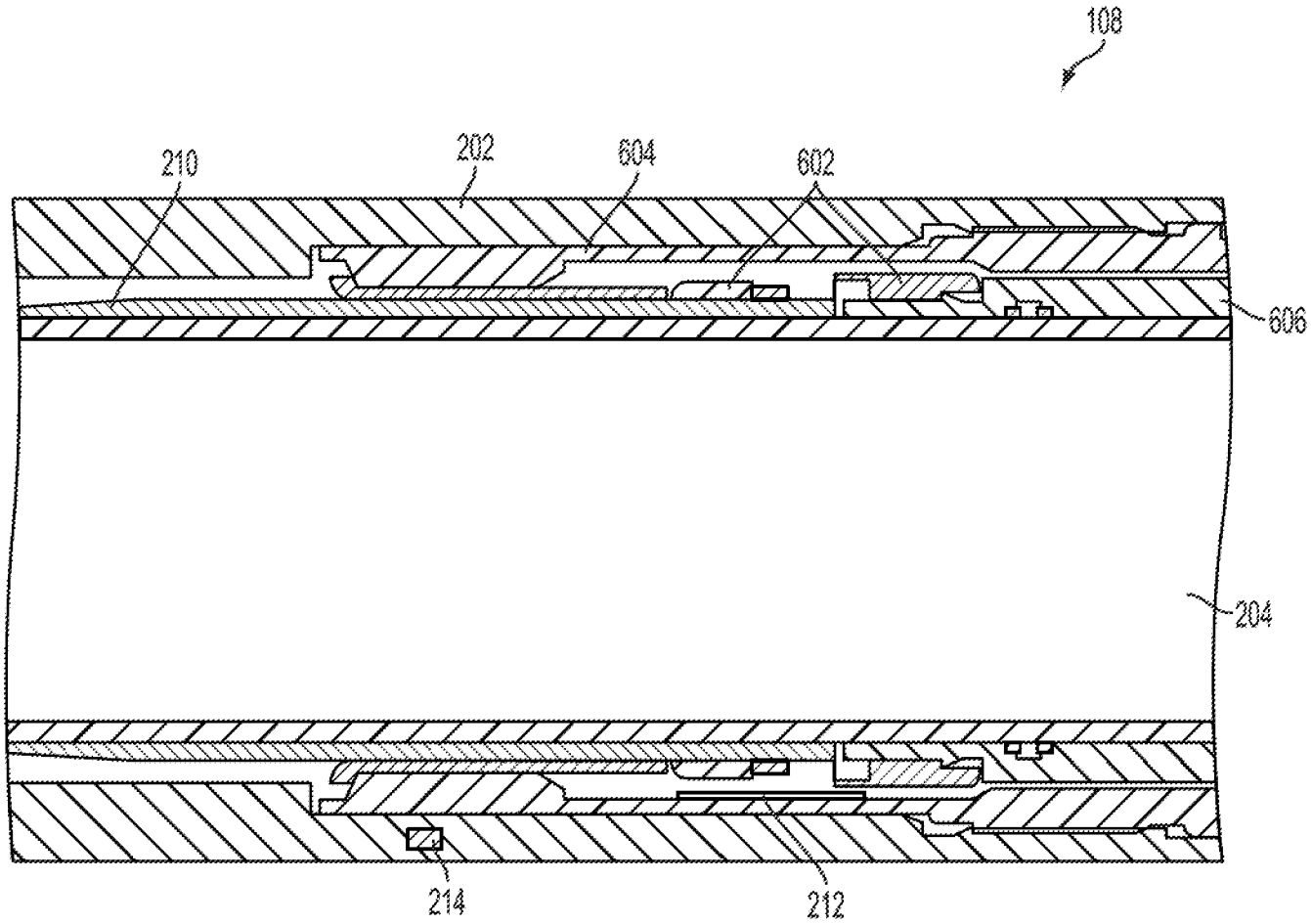
FIG. 6 is a cross-sectional side view of a well system component with a shape-memory alloy actuated fastener according to another embodiment of the present disclosure.

Upon the shape-memory alloy actuated fastener 206 releasing the receiving component 208, in some embodiments, the receiving component 208 can move, for example, to a different position (e.g., to the right as viewed in each of FIGS. 2 and 6). In some embodiments, pressure, gravity, springs, or other means can aid in the receiving component 208 moving to the different position. In some embodiments, when in the different position, the receiving component 208 can keep the closure component in the well-system component 108 in an open position. This can allow fluid or gas communication through the well-system component 108. Unlike with traditional well-system components (e.g., a traditional isolation barrier valve), which can rely on slow, inefficient, and unpredictable hydraulic pressure cycling for remote actuation, in some embodiments, an operator can remotely, quickly, and selectively actuate a well-system component 108 via a shape-memory alloy actuated fastener 206.

In some embodiments, the well-system component 108 can include additional, fewer, or different components. For example, the well-system component 108 can include any number or configuration of shape-memory alloy actuated fasteners 206, a piston, spring (e.g., a power spring), washer, O-ring, seal, hydraulic power assembly or component, screw, transducer, housing, or lock ring. Further, in some embodiments, the well-system component 108 can include an indexing mandrel 210, which is radially positioned between the housing 202 and the tube 204. The indexing mandrel 210 can be used for actuating a well-system component 108 via hydraulic pressure cycling. In some embodiments, an operator can use multiple actuation systems (e.g., a shape-memory alloy actuated fastener 206 and hydraulic pressure cycling) for operating the well-system component 108.

FIG. 6 is a cross-sectional side view of the well-system component 108 with a shape-memory alloy actuated fastener according to another embodiment of the present disclosure. In some embodiments, the well-system component 108 of FIG. 6 is, or can include, a valve, for example, an isolation barrier valve. The well-system component 108 of FIG. 6 can also include the housing 202, the tube 204, the indexing mandrel 210, the temperature-control device 212, and the power supply 214, which can be configured substantially the same of FIG. 6 as described with respect to FIG. 2. Further, the well-system component 108 can include a shape-memory alloy actuated fastener 602, for example, the shape-memory alloy actuated fastener shown in FIG. 7.

Figure 7:
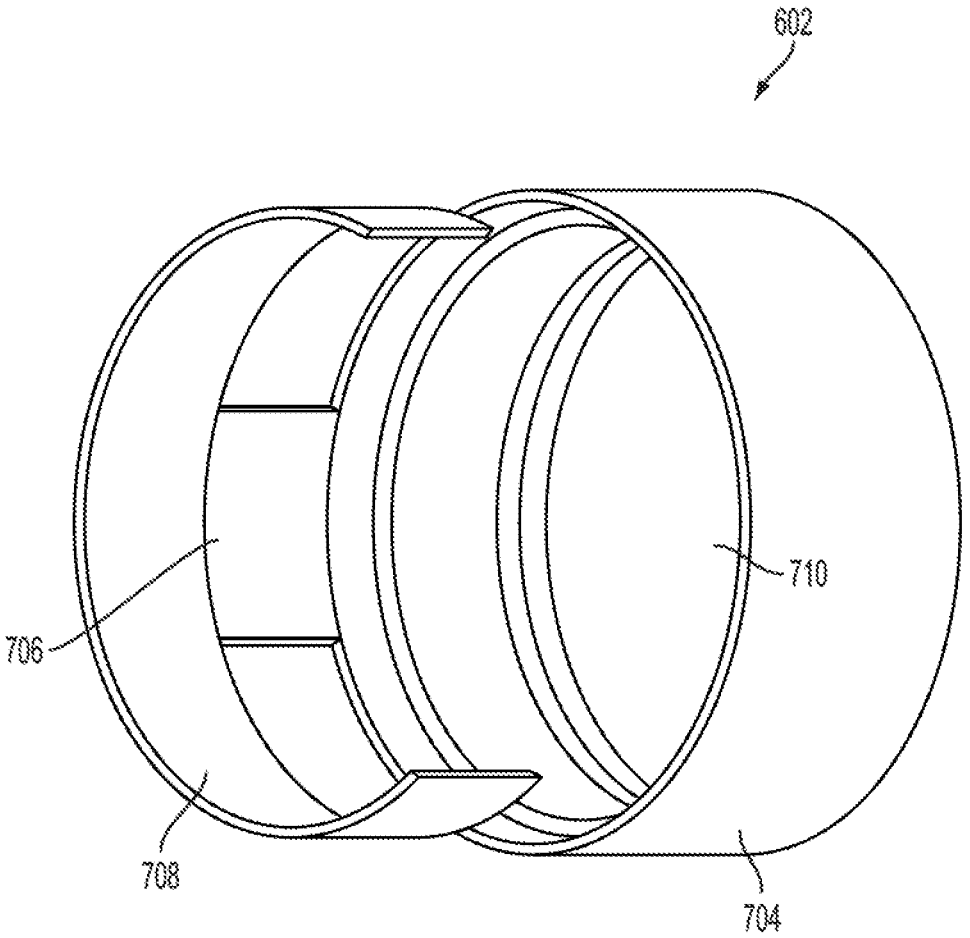
FIG. 7 is a perspective view of the shape-memory alloy actuated fastener in the well-system component of FIG. 6 according to one embodiment of the present disclosure.

FIG. 7 is a perspective view of the shape-memory alloy actuated fastener 602 in the well-system component 108 of FIG. 6 according to one embodiment of the present disclosure. In this example, the shape-memory alloy actuated fastener 602 is a C-ring.

The shape-memory alloy actuated fastener 602 can include a body 704. In some embodiments, the body 704 can include a cylindrical shape. Disposed within the body 704 can be a cylindrically-shaped cavity 710, such that the end of the body 704 includes a ring shape. In other embodiments, the body 704 can include another shape, for example a square, triangular, rectangular, or trapezoidal shape. In some embodiments, the body 704 can include a cavity, for example, for allowing one or more components to fit through the body 704.

A connector 706 can extend from the end of the body 704. The connector 706 can join the cross-sectional end of the body 704 to a locking member 708. In some embodiments, the locking member 708 can include a C-shape. In other embodiments, the locking member 708 can include another shape, for example, a square, ring, circle, triangle, rectangle, or trapezoid shape.

In some embodiments, the entire shape-memory alloy actuated fastener 602 can include a shape-memory alloy. In other embodiments, one or more parts (i.e., components) of the shape-memory alloy actuated fastener 602, for example the body 704 or the locking member 708, can include one or more shape-memory alloys. Further, in some embodiments, the shape-memory alloy actuated fastener 602 may not include the body 704 or the connector 706. That is, in some embodiments, the shape-memory alloy actuated fastener 602 can only include the locking member 708.

Returning to FIG. 6, in some embodiments, one piece of the shape-memory alloy actuated fastener 602 (e.g., the body 704) can be coupled to the well component 606. Another piece of the shape-memory alloy actuated fastener 602 (e.g., the locking member 708) can interlock with a receiving component 604. When the shape-memory alloy actuated fastener 602 is interlocked with the receiving component 604, the receiving component 604 can keep a closure component (e.g., a ball) in the well-system component 108 of FIG. 6 in a closed position. This can close the well-system component 108 of FIG. 6, which can prevent or minimize fluid or gas communication through the well-system component 108.

The well-system component 108 of FIG. 6 can also include the temperature-control device 212 in communication with the power supply 214, as described with respect to FIG. 2. An operator can actuate the power supply 214, which can transmit power to the temperature-control device 212. The temperature-control device 212 can heat or cool the shape-memory alloy actuated fastener 602, which can cause the shape-memory alloy actuated fastener 602 to change into another physical shape, for example, to its high-temperature shape. In some embodiments, the high-temperature shape can include a physical shape in which a piece of the shape-memory alloy actuated fastener 602 (e.g., the locking member 708) has radially expanded or increased in diameter. Upon changing its physical shape, the shape-memory alloy actuated fastener 602 can release the well component 606 from the receiving component 604. In some embodiments, this can cause the well component 606 to be able to move, for example, to a different position (e.g., to the right as viewed in FIG. 6). In some embodiments, pressure, gravity, springs, or other means can aid in the well component 606 moving to the different position. In some embodiments, when in the different position, the well component 606 can keep the closure component (not shown) in the well-system component 108 of FIG. 6 in an open position. This can allow fluid or gas communication through the well-system component 108 of FIG. 6.

Further, in some embodiments, multiple shape-memory alloy actuated fasteners 602 can be used in sequence or in concert. For example, multiple shape-memory alloy actuated fasteners 602 with the same transition temperature, different transition temperatures, or that interlock different combinations of components can be used in sequence or in concert. For example, in some embodiments, the well-system component 108 of FIG. 6 can include multiple shape-memory alloy actuated fasteners 602 actuated by different transition temperatures. Actuating the multiple shape-memory alloy actuated fasteners 602 at different times via different transition temperatures can provide greater control over actuation of the well-system component 108 of FIG. 6.

Figure 8:
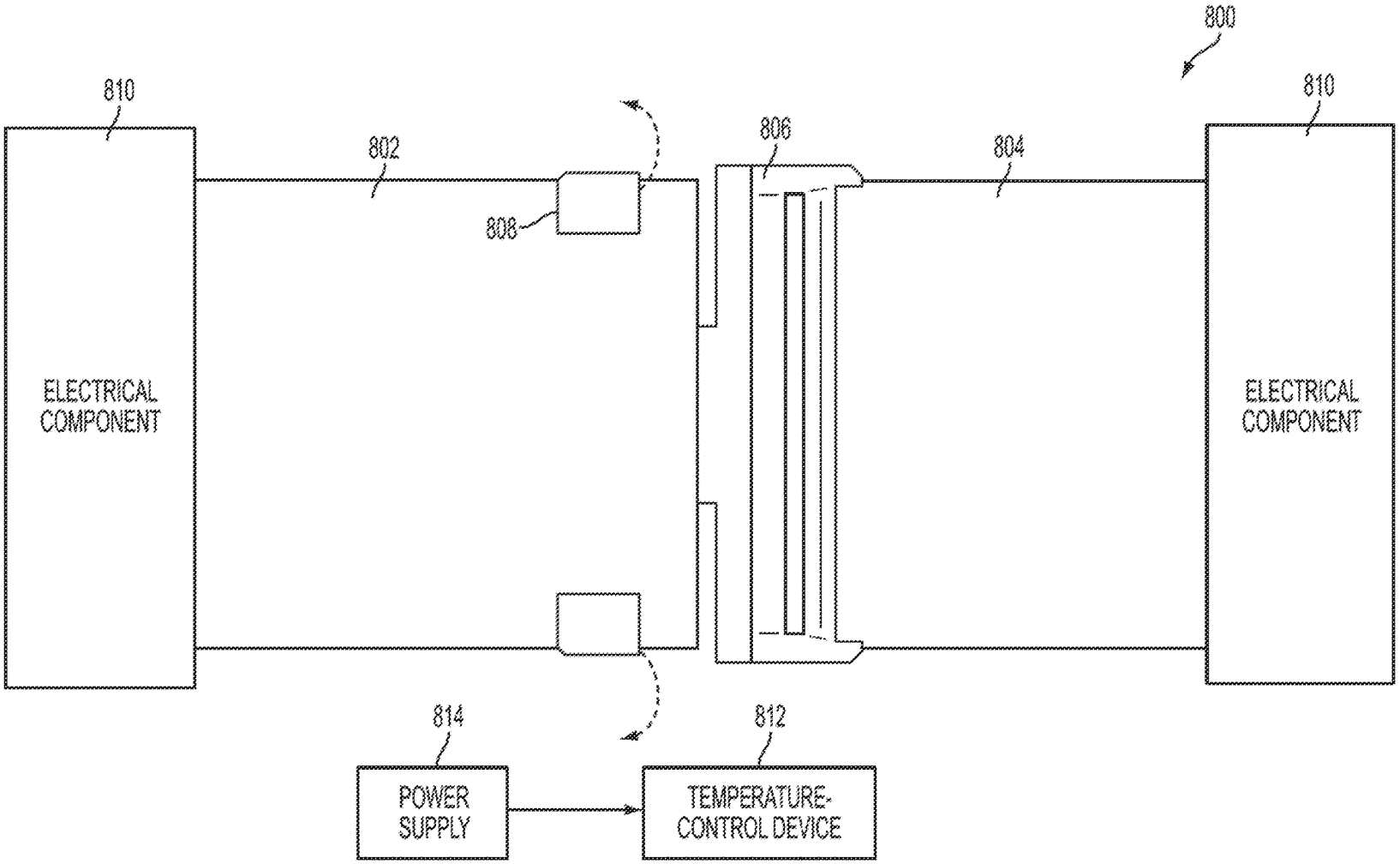
FIG. 8 is a perspective view of a system with a shape-memory alloy actuated fastener according to another embodiment of the present disclosure.

FIG. 8 is a perspective view of a system 800 with a shape-memory alloy actuated fastener according to another embodiment of the present disclosure. In some embodiments, the system 800 can include an electrical component 810. The electrical component 810 can include, for example, a computer, cellular telephone, resistor, capacitor, inductor, integrated circuit component, power supply, processor, microcontroller, memory, or motor. The electrical component 810 can be coupled to a conductor 802 (e.g., a wire or circuit board trace). The conductor 802 can include any suitable conductive material, for example, copper, tin, iron, aluminum, gold, or silver. Another electrical component 810 can be coupled to another conductor 804 (e.g., a wire or circuit board trace). The conductor 804 can include any suitable conductive material, for example, copper, tin, iron, aluminum, gold, or silver.

In some embodiments, the conductors 802, 804 can be releasably coupled by a shape-memory alloy actuated fastener 806. Further, in some embodiments, the conductors 802, 804 can be conductively coupled by the shape-memory alloy actuated fastener 806. The shape-memory alloy actuated fastener 806 can include a shape-memory alloy that includes any conductive material, for example, copper. In the example shown in FIG. 8, the shape-memory alloy actuated fastener 806 includes clasps 808 for releasably coupling the conductors 802, 804. The clasps 808 can include a shape-memory alloy. In other embodiments, the shape-memory alloy actuated fastener 806 may not include the clasps 808.

In some embodiments, the system 800 can also include a temperature-control device 812. The temperature control device 812 can be in communication with a power supply 814. In some embodiments, an operator can actuate the power supply 814, which can transmit power to the temperature-control device 812. In other embodiments, a processor can actuate the power supply 814. For example, in some embodiments, the system 800 (e.g., the electrical component 810) can include a temperature sensor. The temperature sensor can send signals to a processor, which can be positioned within the electrical component 810 or elsewhere. The processor can determine, based on the signals from the temperature sensor, whether a temperature associated with the electrical component 810 or the system 800 has surpassed a threshold. If the threshold has been surpassed, the processor can operate, for example via the power supply 814, the temperature-control device 812. The temperature-control device 812 can heat or cool the shape-memory alloy actuated fastener 806, which can cause the shape-memory alloy actuated fastener 806 to change into another physical shape. This can decouple or couple the conductors 802, 804.

In some embodiments, the system 800 can change temperature independent from the temperature-control device 812, for example, as a result of thermal energy from an electrical circuit or electrical circuit component (e.g., a processor). The changed temperature of the system 800 can cause the shape-memory alloy actuated fastener 806 to change into another physical shape, for example, to its high-temperature shape.

In some embodiments, the high-temperature shape or low-temperature shape can include a physical shape in which a piece of the shape-memory alloy actuated fastener 806 (e.g., the clasps 808) can move, fold, bend, or expand. For example, the high-temperature shape can include a shape in which the clasps 808 fold more than 90 degrees, as depicted by the arrows, such that the clasps 808 release their grip on the conductor 802. Further, in some embodiments, the shape-memory alloy actuated fastener 806 can bend backwards (i.e., in the direction into the page), releasing the conductor 802 from the conductor 804. In some embodiments, this can sever the electrical connection between the conductors 802, 804, preventing electrical communication between the electrical components 810.

In one example, the electrical component 810 coupled to the conductor 802 can include a power supply. The electrical component 810 coupled to the conductor 804 can include a computer. The shape-memory alloy actuated fastener 806 can electrically couple the conductors 802, 804. In some embodiments, if the temperature inside the power supply or computer surpasses the transition temperature of the shape-memory alloy actuated fastener 806, the shape-memory alloy actuated fastener 806 can change its physical shape, for example, to its high-temperature shape. This can decouple or release the conductors 802, 804 from one another. Decoupling the conductors 802, 804 can break the electrical communication between the power supply and the computer, for example, shutting down the computer or otherwise preventing the overheating of the computer. In some embodiments, the system 800 can include an indicator (e.g., a LED or non-electronic indicator) to notify a user, for example, that the decoupling of the electrical component 810 was intentional. Upon the temperature inside the computer cooling below the transition temperature of the shape-memory alloy actuated fastener 806, the shape-memory alloy actuated fastener 806 can change its physical shape, for example, to its low-temperature shape. This can couple or interlock the conductors 802, 804 to each other, which can reestablish electrical communication between the power supply and the computer.

Figure 9:
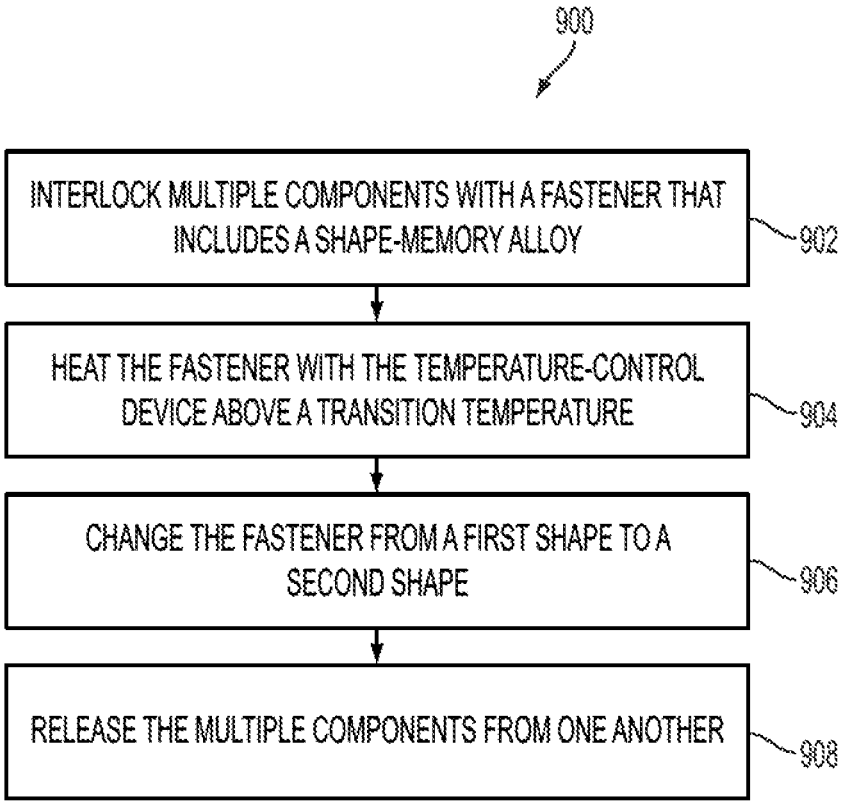
FIG. 9 is a flow chart of an example of a process for using a shape-memory alloy actuated fastener according to one embodiment.

FIG. 9 is a flow chart of an example of a process for using a shape-memory alloy actuated fastener according to one embodiment.

In block 902, multiple components are interlocked with a fastener. The fastener can include a shape-memory alloy. The physical shape of the shape-memory alloy can be selectively changeable between a first shape and a second shape. In some embodiments, the shape-memory alloy can change between physical shapes when heated above a transition temperature. In other embodiments, the shape-memory alloy can change between physical shapes when cooled below a transition temperature.

In block 904, the temperature-control device can heat the fastener above a transition temperature. In some embodiments, the temperature-control device can emit electromagnetic radiation for heating the fastener. In other embodiments, the temperature-control device can heat the fastener via thermal conduction. Any number or combination of heating or cooling methods can be used to heat or cool the fastener.

In block 906, the fastener can change from the first shape into the second shape. For example, in some embodiments, the fastener can change from its low-temperature shape into its high-temperature shape.

In block 908, the fastener can release two or more of the multiple components from each other. In some embodiments, the fastener can release all of the multiple components from each other. In other embodiments, the fastener can release fewer than all of the multiple components from each other.

In some embodiments, the temperature-control device can cool the fastener below the transition temperature. Further, the fastener can change from the second shape back into the first shape.

In some aspects, a system for a shape-memory alloy actuated fastener is provided according to one or more of the following examples.

Example #1

An assembly can include a fastener deployable in a wellbore. The fastener can include a shape-memory alloy for releaseably interlocking multiple components deployable in the wellbore. The physical shape of the shape-memory alloy can be selectively changeable between a first shape and a second shape.

Example #2

The assembly of Example #1 may feature the fastener including multiple shape-memory alloys. Each of the multiple shape-memory alloys can have a different transition temperature.

Example #3

The assembly of any of Examples #1-2 may feature the fastener that is a collet latch or a C-latch.

Example #4

The assembly of any of Examples #1-3 may feature the shape-memory alloy causing the fastener to releaseably interlock the multiple components.

Example #5

The assembly of any of Examples #1-4 may feature the shape-memory alloy releasably interlocking the plurality of components. The first shape can be configurable for interlocking the plurality of components and the second shape can be configurable for releasing the plurality of components.

Example #6

The assembly of any of Examples #1-5 may feature the physical shape of the shape-memory alloy being changeable between the first shape and the second shape by heating or cooling the shape-memory alloy.

Example #7

The assembly of any of Examples #1-6 may feature a temperature-control device for heating or cooling the shape-memory alloy.

Example #8

The assembly of any of Examples #1-7 may feature the a valve deployable in the wellbore. The fastener can be usable with the valve in the wellbore. The valve can include a receiving component to which the fastener can be releaseably coupled. The receiving component can be moveable to open or close the valve.

Example #9

The assembly of any of Examples #1-8 may feature the valve being an isolation barrier valve. The valve can also include an indexing mandrel for opening the valve.

Example #10

A system can include a fastener. The fastener can include a shape-memory alloy for releasably interlocking multiple components deployable in a wellbore. The physical shape of the shape-memory alloy can be selectively changeable between (i) a first shape configurable for interlocking the multiple components and (ii) a second shape configurable for releasing the multiple components. The system can also include a temperature control device for heating or cooling the shape-memory alloy to change the shape-memory alloy between the first shape and the second shape.

Example #11

The system of Example #10 may feature a power source for operating the temperature-control device.

Example #12

The system of any of Examples #10-11 may feature the fastener including multiple shape-memory alloys. Each of the multiple shape-memory alloys can have a different transition temperature.

Example #13

The system of any of Examples #10-12 may feature the fastener including a collet latch or a C-latch.

Example #14

The system of any of Examples #10-13 may feature the shape-memory alloy causing the fastener to releaseably interlock the multiple components.

Example #15

The system of any of Examples #10-14 may feature a valve deployable in a wellbore. The fastener can be usable with the valve in the wellbore. The valve can include a receiving component to which the fastener can be releaseably coupled. The receiving component can be moveable to open or close the valve.

Example #16

The system of any of Examples #10-15 may feature the valve being an isolation barrier valve. The valve can also include an indexing mandrel for opening the valve.

Example #17

A method can include interlocking multiple components deployed in a wellbore with a fastener that can include a shape-memory alloy. The physical shape of the shape-memory alloy can be selectively changeable between a first shape and a second shape. The method can also include heating the fastener, by a temperature-control device, above a transition temperature. The method can further include changing the fastener from the first shape to the second shape. Finally, the method can include releasing the multiple components from one another.

Example #18

The method of Example #17 may feature heating the fastener by the temperature-control device responsive to the temperature-control device receiving a power from a power source positioned in a wellbore.

Example #19

The method of any of Examples #17-18 may feature cooling the fastener, by the temperature-control device, below the transition temperature. The shape-memory alloy can change from the second shape to the first shape.

Example #20

The method of any of Examples #17-19 may feature moving at least one of the multiple components to open the valve in the wellbore.

The foregoing description of certain embodiments, including illustrated embodiments, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly, comprising:

a fastener deployable in a wellbore, the fastener comprising a first shape-memory alloy and a second shape-memory alloy for releaseably interlocking a plurality of components deployable in the wellbore, wherein the first shape-memory alloy is different from the second shape-memory alloy, and wherein the first shape-memory alloy and the second shape-memory alloy each have a respective transition temperature and a respective physical shape that is selectively changeable between a first shape and a second shape.

2. The assembly of claim 1, wherein the first shape-memory alloy has a first transition temperature and the second shape-memory alloy has a second transition temperature that is different from the first transition temperature.

3. The assembly of claim 1, wherein the fastener is a collet latch or a C-latch.

4. The assembly of claim 1, wherein the first shape-memory alloy is configured to cause the fastener to releaseably interlock with the plurality of components.

5. The assembly of claim 4, wherein the first shape of the first shape-memory alloy is configurable for interlocking the plurality of components and the second shape of the first shape-memory alloy is configurable for releasing the plurality of components.

6. The assembly of claim 1, wherein the respective physical shape of the first shape-memory alloy is changeable between the first shape and the second shape by heating or cooling the first shape-memory alloy.

7. The assembly of claim 6, further comprising a temperature-control device for heating or cooling the first shape-memory alloy.

8. The assembly of claim 1, further comprising a valve deployable in the wellbore, wherein the fastener is usable with the valve in the wellbore, wherein the valve comprises a receiving component to which the fastener is releaseably coupled, and wherein the receiving component is moveable to open or close the valve.

9. The assembly of claim 8, wherein the valve is an isolation barrier valve, and wherein the valve further comprises an indexing mandrel for opening the valve.

10. A system, comprising:

a fastener comprising a first shape-memory alloy and a second shape-memory alloy for releaseably interlocking a plurality of components deployable in a wellbore, wherein the first shape-memory alloy is different from the second shape-memory alloy, and wherein the first shape-memory alloy and the second shape-memory alloy each have a respective transition temperature and a respective physical shape that is selectively changeable between a first shape and a second shape; and a temperature-control device for heating or cooling at least one of the first shape-memory alloy or the second shape-memory alloy.

11. The system of claim 10, further comprising a power source for operating the temperature-control device.

12. The system of claim 10, wherein the first shape-memory alloy has a first transition temperature and the second shape-memory alloy has a second transition temperature that is different from the first transition temperature.

13. The system of claim 10, wherein the fastener is a collet latch or a C-latch.

14. The system of claim 10, wherein the first shape-memory alloy is configured to cause the fastener to releaseably interlock with the plurality of components.

15. The system of claim 10, further comprising a valve deployable in the wellbore, wherein the fastener is usable with the valve in the wellbore, wherein the valve comprises a receiving component to which the fastener is releaseably coupled, and wherein the receiving component is moveable to open or close the valve.

16. The system of claim 15, wherein the valve is an isolation barrier valve, and wherein the valve further comprises an indexing mandrel for opening the valve.

17. A method, comprising:

interlocking a plurality of components deployed in a wellbore with a fastener comprising a first shape-memory alloy and a second shape-memory alloy, wherein the first shape-memory alloy is different from the second shape-memory alloy, and wherein the first shape-memory alloy and the second shape-memory alloy each have a respective transition temperature and a respective physical shape that is selectively changeable between a first shape and a second shape;

heating the fastener, by a temperature-control device, above a transition temperature;

changing the first shape-memory alloy from a respective first shape to a respective second shape; and releasing the plurality of components from one another.

18. The method of claim 17, wherein the temperature-control device heats the fastener in response to the temperature-control device receiving a power from a power source positioned in a wellbore.

19. The method of claim 17, further comprising:

cooling the fastener, by the temperature-control device, below the transition temperature; and changing the first shape-memory alloy from the respective second shape to the respective first shape.

20. The method of claim 17, further comprising moving at least one of the plurality of components to open a valve in the wellbore.

* * * * *